US006844665B2

(12) United States Patent
Steinhauser et al.

(10) Patent No.: US 6,844,665 B2
(45) Date of Patent: Jan. 18, 2005

(54) DISPLAY DEVICE AND CATHODE RAY TUBE

(75) Inventors: Heidrun Steinhauser, Eindhoven (NL); Ronald Johannes Gelten, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/024,740

(22) Filed: Dec. 19, 2001

(65) Prior Publication Data

US 2002/0113539 A1 Aug. 22, 2002

(30) Foreign Application Priority Data

Dec. 22, 2000 (EP) ..... 00204790

(51) Int. Cl.[7] ..... H01J 29/50
(52) U.S. Cl. ..... 313/414; 313/412
(58) Field of Search ..... 313/412, 414, 313/425, 432, 437, 439, 444, 446; 315/15, 382

(56) References Cited

U.S. PATENT DOCUMENTS 5,347,202 A * 9/1994 Stil ..... 315/382
5,404,071 A * 4/1995 Son ..... 313/414
5,539,278 A * 7/1996 Takahashi ..... 313/14
5,734,235 A * 3/1998 Noguchi ..... 313/382

* cited by examiner

*Primary Examiner*—Ashok Patel

(57) ABSTRACT

A display device comprising a deflection unit and a cathode ray tube having an in-line electron gun. The electron gun comprises a main lens portion having means for generating a main lens field and an auxiliary field. Furthermore, the electron gun comprises a prefocusing lens portion having a first, a second and a third electrode for generating a prefocusing lens field. In operation, in a direction perpendicular to the in-line plane, the auxiliary field and the main lens cause the electron beam to leave the main lens substantially parallel to the in-line plane, whereby the diameter of the electron beam at a gap of the main lens at the anode side is smaller than or equal to the diameter of the aperture of the second electrode throughout the deflecton of the electron beam across the display screen. By virtue thereof, an improved picture reproduction can be obtained.

11 Claims, 4 Drawing Sheets

DISPLAY DEVICE AND CATHODE RAY TUBE

Figure 1:
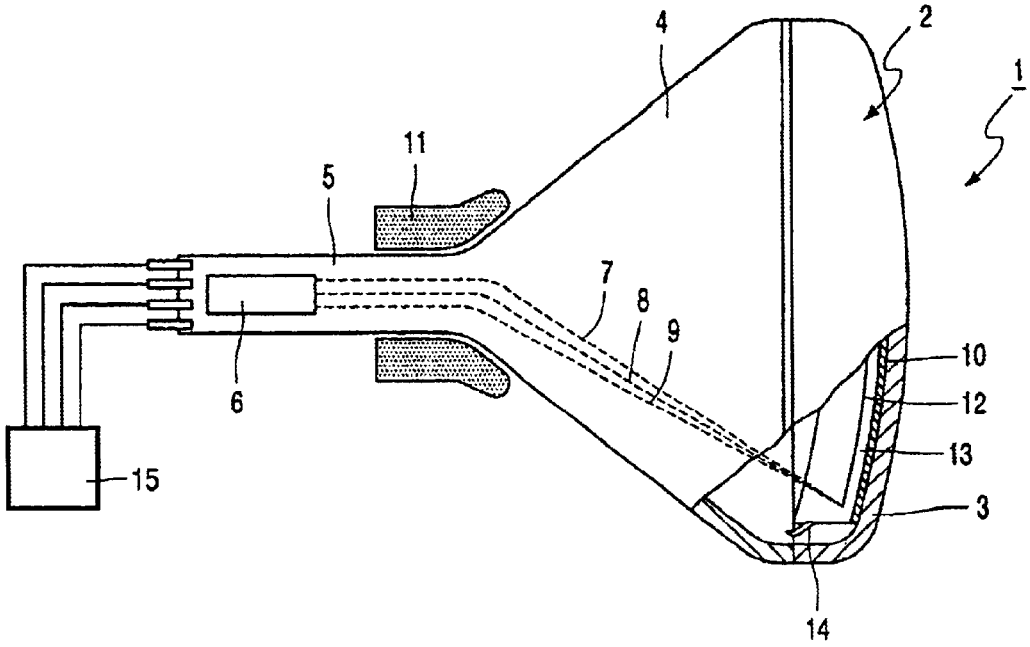

The invention relates to a display device as defined in the precharacterizing part of claim 1.

The invention also relates to a cathode ray tube which is suitable for use in a display device.

Such a display device is used in, inter alia, television displays and computer monitors.

A display device of the kind mentioned in the opening paragraph is known from EP-A 509590. The device which is provided with a deflection unit and a cathode ray tube having an in-line electron gun. The electron gun comprises a main lens portion having means for generating a main lens and a first quadrupole field. During operation, the intensity of said fields is dynamically varied. This allows astigmatism and focusing of the electron beams as a function of the deflection to be controlled so that astigmatism caused by the deflection is at least partly compensated and the electron beams are substantially in focus throughout the display screen. The electron gun comprises a pre-focussing lens portion having means for generating a prefocusing lens field and a further quadrupole field. In the known device, the intensity of said fields is controlled during operation so that a dynamic lens is formed in the prefocusing lens portion for reducing the beam angle in the vertical direction. In the known display device, the intensity of the dynamic voltage is applied to the means for dynamically generating the quadrupole field.

In display devices according to the state of the art having a real flat surface on the outer side of the display screen disturbing pictures may occur in particular at the edges of the display screen. For example, characters may become less distinct as they are reproduced closer to the corners of the display screen.

It is an object of the invention to provide a display device having an improved picture quality. This object is achieved by the display device according to the invention as defined in claim 1. The invention is, inter alia, based on the recognition that by providing an auxiliary field whose intensity is adapted, in such a way, that the trajectories of the electrons of the beam leave the main lens substantially parallel, the diameter of the electron beam in the direction perpendicular to the in-plane direction is much smaller as compared with the diameter of the electron beam in the direction parallel to the in-line plane and the trajectories of the electron beam in the direction perpendicular to the in-plane direction substantially coincide with the principal axis of the main lens. Therefore, the effect of the lens is virtually zero and the spot is in focus everywhere on the screen during deflection of the electron beam. Furthermore, the spot size in the direction perpendicular to the in-plane direction on the display screen is substantially uniform in the center as well as in the comers of the display screen. As a result, the picture quality is improved. In the known display device, the trajectories of electrons at the outer side of the beam pass the main lens with a relatively large diameter in the direction perpendicular to the in-plane direction, and the spherical aberration of the electron beam due to the main lens is large and the electron beam becomes out of focus at the comers of the display screen.

In a known display device, an increasingly positive effect of the prefocusing lens and a converging effect of the second dynamic quadrupole in a direction perpendicular to the in-plane direction reduce the beam angle of the electron beam entering the main lens, and an increasingly negative effect of the first quadrupole and a decreasingly positive effect of the main lens maintain focus of the electron beam in the comers as well as in the center of the display screen.

A further advantage is that a dynamic voltage for generating dynamic auxiliary fields is no longer required because of the application of a static auxiliary field.

In this patent application, horizontal is to be understood in a direction parallel to the in-line plane and vertical is to be understood in a direction transverse to the in-line plane. Furthermore, a quadrupole field modulates the shape of an electron beam. It reduces the size of the electron beam in one direction and increases the size of an electron beam in a direction perpendicular to said direction.

An astigmatic field modulates the shape of an electron beam in such a way that the size of an electron beam is reduced in the horizontal direction as well as in the vertical direction, but the reduction in the vertical direction is larger than the reduction in the horizontal direction.

A prefocusing field influences, that is, increases or reduces, the size of an electron beam in all directions to an approximately equal degree.

A particular embodiment of the display device according to the invention is defined in dependent claim 2. One possibility of obtaining the auxiliary electric field is to apply a first quadrupole field in the main lens portion and a second quadrupole field in the prefocusing lens portion. In this design the quadrupole fields can be established by fixed potentials on the different grids. An advantage of this design is that it allows many degrees of freedom for optimizing the electron gun.

A different embodiment of the display device according to the invention is defined in dependent claim 5. Another possibility of obtaining the auxiliary lens field is to apply an astigmatic lens field in the prefocusing lens portion. This design of the display device requires a relatively simple electron gun with only a few grids.

Further advantageous embodiments of the display device according to the invention are defined in the dependent claims.

These and other aspects of the invention are apparent from and will be elucidated with reference to the embodiments described hereinafter.

In the drawings

Figure 2:
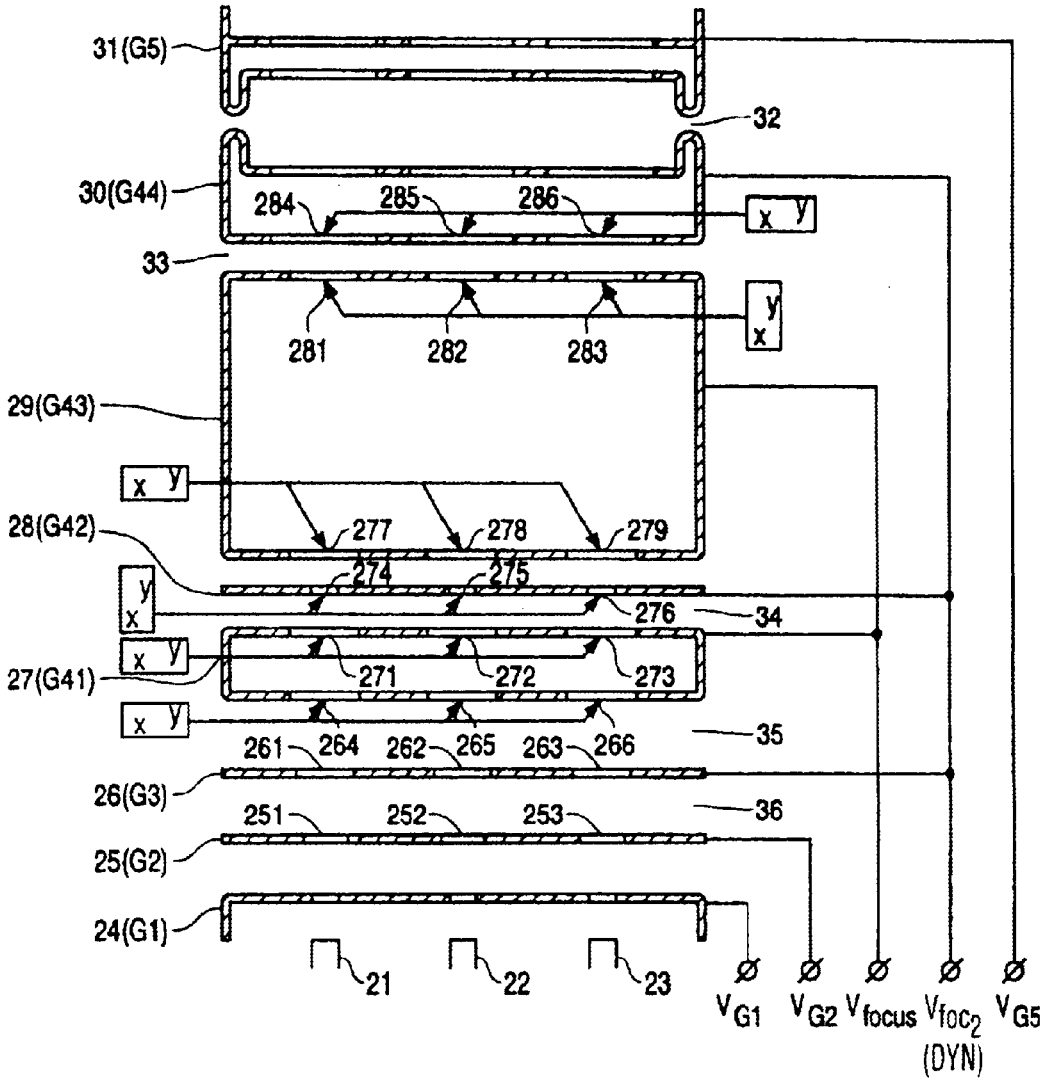
Figure 3:
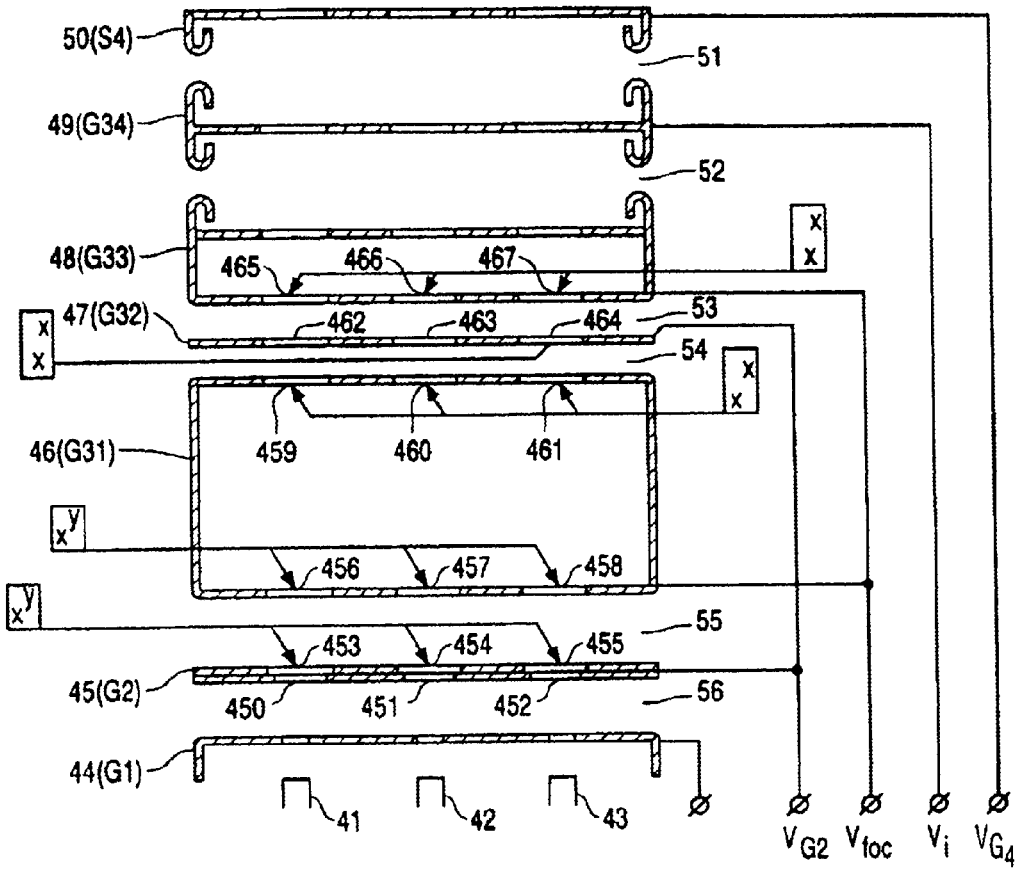
Figure 4:
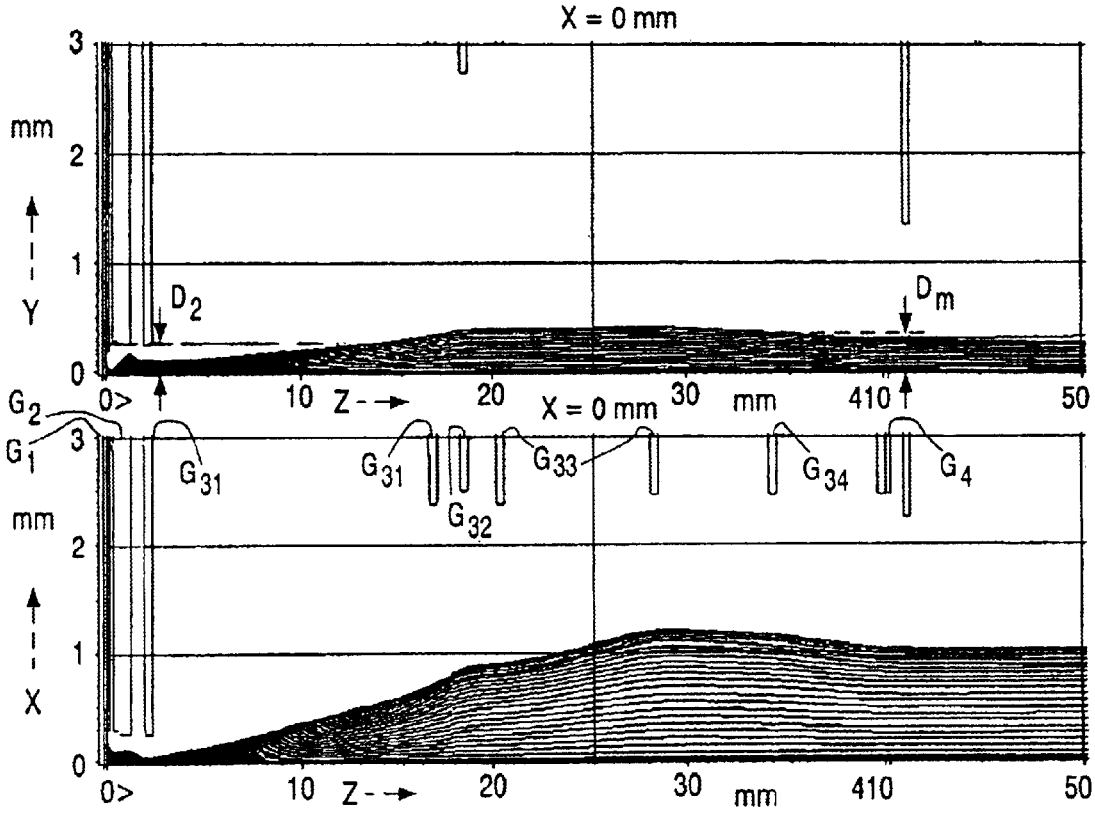

FIG. 1 is a sectional view of a display device,

FIG. 2 is a sectional view of a first example of an electron gun which can suitably used in a cathode ray tube for a display device, FIG. 3 Is a sectional view of a second example of an electron gun which can be suitable used in a cathode ray tube for a display device and FIG. 4 shows a simulation of a beam section of a display device in the vertical direction and the horizontal direction of the display device.

The display device comprises a cathode ray tube, in this example a color display tube 1, having an evacuated envelope 2 which consists of a display window 3, a cone portion 4 and a neck 5. The neck 5 accommodates an electron gun 6 for generating three electron beams 7, 8 and 9 which extend in one plane, the in-line plane which in this case is the plane of the drawing. A display screen 10 is provided on the inner side of the display window. Said display screen 10 comprises a large number of phosphor elements luminescing in red, green and blue. On their way to the display screen 10, the electron beams 7, 8 and 9 are deflected across the display screen 10 by means of a deflection unit 11 and pass through a color selection electrode 12 which is arranged in front of the display window 3 and comprises a thin plate with apertures 13. The color selection electrode is suspended in the display window by means of suspension means 14. The three electron beams 7, 8 and 9 pass through the apertures 13 of the color selection electrode at a small angle to each other. Consequently, each electron beam impinges on phosphor elements of only one color. The display device further comprises means 15 for generating voltages which, in operation, are applied to components of the electron gun.

FIG. 2 is a sectional view of a first example of an electron gun which is suitable for use in a cathode ray tube in a display device according to the invention. The electron gun 6 comprises three cathodes 21, 22 and 23. It further comprises a first common electrode 24 ($G_1$), a second common electrode 25 ($G_2$), a third common electrode 26 ($G_3$), a fourth common electrode 27 ($G_{41}$), a fifth common electrode 28 ($G_{42}$), a sixth common electrode 29 ($G_{43}$), a seventh common electrode 30 ($G_{44}$) and an eighth common electrode 31 ($G_5$) Electrodes 31 ($G_5$) and 30 ($G_{44}$) form an electron-optical element in the main lens portion of the electron gun for generating a main lens field which is formed, in operation, between said electrodes 30 and 31 in space 32. Alternatively, the main lens portion may be formed by a distributed composed main lens field. (DCFL).

Furthermore, the apertures 251, 252 and 253 in electrode 25 ($G_2$) are round, in this example, as are the apertures 264, 265 and 266 in electrode 26 ($G_3$). In operation, a rotationally symmetrical prefocusing lens is formed between the electrodes 25 and 26.

The electrodes have connections for applying electric voltages. The display device comprises leads, not shown, for applying electric voltages which are generated in the means 15. The cathodes and the electrodes 24 and 25 form the so-called triode portion of the electron gun. Electrodes 25 ($G_2$) and 26 ($G_3$) form an electron-optical element in the prefocusing lens portion of the electron gun for generating a first prefocusing field approximately in space 36.

Particularly in the case of color display tubes having a substantial (for example 110° or more) angle of deflection and a real flat display screen, disturbing effects may occur because the spot is not uniform across the display screen.

In order to improve the spot uniformity during deflection of the electron beam across the screen, electrodes 30 ($G_{44}$) and 29 ($G_{43}$) form an electron-optical element in the main lens portion of the electron gun for generating an auxiliary electric field, in this example a first quadrupole field which, in operation, is generated between the electrodes 30 and 29 in space 33.

Furthermore, electrodes 27 ($G_{41}$), 28 ($G_{42}$) and 29($G_{43}$) form an electron optical element in the prefocusing lens portion of the electron gun for generating a first further auxiliary electric field, in this example a second quadrupole field in space 34 between electrode 28 (G42) and 29 (G43). Electrodes 27 ($G_{32}$) and 26 ($G_{31}$) form an electron-optical element in the prefocusing lens portion of the electron gun for generating a second further auxiliary electric field, in this example, a third quadrupole field in space 35 between the electrodes 26 and 27. All electrodes have apertures for transmitting the electron beams. In this example, apertures 281, 282 and 283 are rectangular as are apertures 284,285 and 286. This is diagrammatically shown by means of rectangles beside the apertures. Apertures 271,272 and 273, apertures 274, 275 and 276, and apertures 277, 278 and 279 are also rectangularly shaped as is diagrammatically shown beside said apertures. Apertures 264,265 and 266 are also rectangularly shaped as is diagrammatically shown by means of a rectangle beside the apertures.

In operation, a potential $Vfoc_2$ is applied to electrodes 30 (G44), 28 (G42) and 26(G3). Said potential $Vfoc_2$ is, for example, 6900 V. Furthermore, a potential VG5) of approximately 25 kV to 30 kV is applied to electrode 31 (G5), also termed anode. The electron beams are deflected across the display screen 10 by deflection unit 11. The electromagnetic deflection field also has a focusing effect and causes astigmatism. Said effects are governed by the deflection angle of the electrons. The apertures are selected so that the effect of the potential applied to electrode 30 (G44) on the beam size in the horizontal direction and brought about in the main lens is of opposite sign, and the effect on the beam size in the horizontal direction brought about in the first quadrupole field causes a net positive lens action in the horizontal direction. Furthermore, in the vertical direction the lens actions of the main lens field and the first quadrupole field intensify each other and, together with the lens actions of the second and third quadrupole fields, cause the electron beam to leave the main lens substantially parallel to the in-line plane, whereby the diameter of the electron beam at an aperture of electrode 31 ($G_5$) of the main lens is smaller than or equal to the diameter of the aperture 251,252,253 of the second electrode 45 ($G_2$) throughout the deflection of the electron beam across the display screen 10. It should be noted that the diameter of the electron beam 7, 8, 9 varies with the anode current. For small currents of the order of 1 mA, the diameter of the electron beam 7, 8, 9 in the vertical direction at an aperture of the electrode 31 ($G_5$) of the electron gun 6 will thus be less than the aperture of the second electrode G2. However, for high currents, i.e. more than 3 mA, the diameter in the vertical direction at a gap of the main lens at the anode side of the electron gun will be larger than the aperture of the second electrode G2. In practice, for nominal beam currents of approximately 2 mA the diameter in the vertical direction at a gap of the main lens at the anode side of the electron gun will be equal to the aperture of the second electrode G2.

Table 1 and Table 2 show half the beam angle in the x-direction (x) and in the y-direction (y) of the electron beams on the display screen, as a function of the potential $V_{foc2}$ applied to electrodes 26 ($G_{31}$) and 28($G_{42}$) at beam currents of 0.5 mA and 2.0 mA, respectively. In this example, it holds that:

diameter of apertures in electrode 25 ($G_{2a}$): 0.580 mm diameter of apertures in electrode 25 ($G_{2b}$): 0.490 (x)× 0.520 (y) mm diameter of apertures in electrode 26 ($G_{3a}$): 0.390 (x)× 0.430 (y) mm diameter of apertures in electrode 26 ($G_{3b}$): 2.000 (x)× 4.000 (y) mm apertures 264, 265 and 266: 4 (x)×0.9 (y) mm apertures 271, 272 and 273: 4.5 (x)×1.8(y)mm apertures 274, 275 and 276: 1.8 (x)×4.5(y)mm apertures 277, 278 and 279: 4.5 (x)×1.8(y)mm apertures 281, 282 and 283: 2.95 (x)×7.0(y)mm apertures 284, 285 and 286: 4.8 (x)×2.95(y)mm where the potential $V_{G2}$ applied to electrode 25 (G2) is approximately 700 Volts and the potential Vfoc applied to electrodes 27 ($G_{41}$) and 29 ($G_{43}$) is approximately 5400 Volts.

TABLE 1 half the beam angle in the x- and y-directions as a function of the dynamic potential $V_{foc2}$ at a beam current of 0.5 mA.

| | Half the beam angle (mrad) at 0.5 mA | |
|---|---|---|
| $V_{foc2}$ (Volt) | X | Y |
| 5400 (0 V) | 13 | 22 |
| 5900 (500 V) | 26 | 6 |
| 6400 (1000 V) | 41 | 1 |
| 6900 (1500 V) | 56 | 0 |

TABLE 2 half the beam angle in the x- and y-directions as a function of the dynamic potential $V_{foc2}$ at a beam current of 2.0 mA.

| | Half the beam angle (mrad) at 2.0 mA | |
|---|---|---|
| $V_{foc2}$ (Volt) | X | Y |
| 5400 (0 V) | 22 | 58 |
| 5900 (500 V) | 42 | 27 |
| 6400 (1000 V) | 65 | 9 |
| 6900 (1500 V) | 89 | 0.5 |

The beam section in a direction (in this example the x or y-direction) on the display screen is governed by the beam angle in said direction, in the following manner: the beam angle is the angle ($\alpha$) at which the electron beam enters the main lens. For a main lens it holds that the Helmholtz-Lagrange product (HL) is constant in a first-order approximation, which product complies with the equation $$HL = \frac{\alpha}{2} * B * \sqrt{V}$$

wherein B represents the beam section in the direction in question and V represents the voltage applied to the anode. The beam section increases as the beam angle decreases.

The beam angle and, hence, the beam section in the vertical (y)-direction as well as the beam angle and, hence, the beam section in the horizontal (x)-direction can be varied substantially, as shown in Table 1 and Table 2, by varying the potential $V_{foc2}$ applied to electrodes 26 ($G_3$), 28 ($G_{42}$) and 30 ($G_{44}$). In order to obtain an electron beam with a diameter equal to the diameter of the aperture of electrode 45 ($G_2$), the potential $V_{foc2}$ is set at 6900 V.

In the example, the quadrupole fields are generated between two electrodes having quadrangular apertures. The apertures may alternatively be oval, elongated or polygonal.

A quadrupole field may be generated in a different manner, for example, by raised, oppositely located edges at apertures for transmitting electron beams.

In operation, the first quadrupole field, viewed in the direction of travel of the electron beams, may be located in front of or behind the main lens field or it may be integrated therein.

It is advantageous when the means for generating the prefocusing field and the quadrupole field are constructed so that it can be excited with only one voltage, as is the case in the example stated above. In this example, the voltage is applied to the common electrode $G_{31}$.

In order to improve the second quadrupole field and the third quadrupole field, it is also possible to exchange the plate electrode 26 ($G_3$) with a bus electrode 28 having apertures 261, 262, 263 and apertures 261', 262', 263'.

It is also possible to omit the electrode 28 ($G_{42}$) and generate only a second quadrupole field by the electrodes 27 ($G_{41}$) and 29 ($G_{43}$) which may cause some beam interception at the electrodes 27 ($G_{41}$) and 29($G_{43}$). Furthermore, in order to enhance the second quadrupole field, it is possible to provide the apertures 271,272,273 and 277,278,279 in electrodes 27 en 29 with raised, oppositely located edges.

FIG. 3 is a sectional view of a second example of an electron gun which is suitable for use in a cathode ray tube and display device according to the invention. The electron gun 6 comprises three cathodes 41,42,43. It further comprises a first common electrode 44 ($G_1$), a second common electrode 45 ($G_2$), a third common electrode 46 ($G_{31}$), a fourth common electrode 47 ($G_{32}$), a fifth common electrode 48 ($G_{33}$), a sixth common electrode 49 ($G_4$) and a seventh electrode 50 ($G_5$). Electrodes 48 ($G_{33}$), 49 ($G_{34}$) and 50 ($G_4$) form a distributed composed main lens field (DCFL) in spaces 51 and 52. The electrodes have connections for applying electric voltages. The display device comprises leads, not shown, for applying electric voltages which are generated in the means 15.

The electrodes 46 ($G_{31}$), 47 ($G_{44}$) and 48 ($G_{43}$) form an electron-optical element in the main lens portion of the electron gun for generating an auxiliary electric field, in this example, an astigmatic lens field, which is generated between the respective electrodes 46,47,48 ($G_{31}$, $G_{44}$, $G_{43}$)in space 53,54, at the anode side of the main lens whereby the intensity of the astigmatic lens field in the direction perpendicular to the in-line plane is stronger than the intensity of the astigmatic lens field in the in-line plane. The cathodes 41,42,43 and the electrodes 44 (G1) and 45 (G2) form the so-called triode portion of the electron gun. Electrodes 45 ($G_2$) provided with apertures 450,451,452 and 46 ($G_3$) form an electron-optical element in the prefocusing lens portion of the electron gun for generating a first prefocusing field approximately in space 55. Furthermore, electrodes 45 ($G_2$) and 46 ($G_{31}$) form an electron optical element in the prefocusing lens portion of the electron gun for generating an auxiliary electric field in space 55, in this example, a further astigmatic lens field. All electrodes have apertures for transmitting the electron beams. In this example, apertures 459, 460, 461 are rectangular as are apertures 462, 463, 464 and apertures 465, 466, 467. This is diagrammatically shown by means of rectangles beside the apertures. Apertures 453, 454 and 455, and apertures 456,457 and 458 are also rectangularly shaped as is diagrammatically shown beside said apertures.

In operation, a potential $V_{G2}$ is applied to electrodes 45 ($G_2$), 47 ($G_{32}$). The intensity of the astigmatic field lens is adapted by the form of the apertures 459,460,461 and 462,463,464 and 465,466,467 in the electrodes 46($G_{31}$), 47($G_{32}$), 48($G_{33}$) in respective electrodes 46, 47 and 48. In order to provide a uniform spot size during deflection of the electron beam across the display screen, the potentials Vfoc and $VG_2$ applied to the respective electrodes 46,47,48 and the shapes of the apertures are chosen in such a way that in the vertical direction, the lens actions of the astigmatic lens field and the further astigmatic lens field intensify each other, causing the electron beam to leave the main lens substantially parallel to the in-line plane, whereby the diameter of the electron beam in the aperture of electrode 50 ($G_4$) of the main lens at the anode side is smaller than or equal to the diameter of the aperture 453,454,455 of the second electrode 45 $G_2$ throughout the deflecton of the electron beam across the display screen 10.

In this example, it holds that diameter of apertures in electrode 44 (G1): 0.575 (x)× 0.376(y)

diameter of apertures in electrode 45 (G2*b*): r=0.580 diameter of apertures in electrode 45 ($G_{2b}$): 0.520 (x)× 0.520 (y) mm diameter of apertures in electrode 46 ($G_{3a}$): 0.500 (x)× 0.500 (y) mm diameter of apertures in electrode 47 ($G_{3b}$): 4.750 (x)× 6.000 (y) mm apertures 462, 463 and 464: 5.000 (x)×5.500 (y) mm apertures 465, 466 and 467: 4.750 (x)×6.000 (y )mm.

The potential $V_{foc}$ applied to the electrodes 46 ($G_{31}$) an 48 ($G_{33}$) is 8000 V. The potential $V_{g2}$ is, for example, 800V. The potential $V_i$ applied to electrode 49 is 15 kV and the potential $V_{g4}$ applied to electrode 50 is the anode potential 30 kV. For this small diameter of the electron beam in the vertical direction, the electron beam will be in focus everywhere on the screen during deflection of the electron beam, both in the center and in the comers of the screen.

FIG. 4 shows a result of a simulation of the electron gun described with reference to FIG. 3.

The upper part of FIG. 4 is a cross-section of an electron beam in the vertical direction in an electron gun according to the invention. The potentials on the respective electrodes $G_1$,$G_2$,$G_{31}$,$G_{32}$,$G_{33}$,$G_{34}$ and $G_4$ and the shape and dimensions of the apertures of the electrodes are such that they cause the electron beam to leave the main lens substantially parallel to the in-line plane, the diameter D2 of the electron beam in an aperture of electrode 50(G4) of the main lens at the anode side being smaller than or substantially equal to the diameter D1 of an aperture 453,454 and 454 of the second electrode 45 ($G_2$) throughout the deflecton of the electron beam across the display screen 3.

The lower part of FIG. 4 shows the shape of the electron beam in a horizontal direction. FIG. 4 shows the position of the respective electrodes $G_1$,$G_2$,$G_{31}$,$G_{32}$,$G_{33}$,$G_{34}$ and $G_4$ in the electron gun, and the diameter of the electron beam in the horizontal direction is much larger than the diameter of the electron beam in the vertical direction.

It will be clear that many variations are possible within the framework of the invention.

What is claimed is:

1. A display device comprising a cathode ray tube, a deflection unit and display screen, the cathode ray tube including an in-line electron gun comprising:

a main lens portion for generating a main lens field;

a pre-focusing lens portion which, viewed in the direction of travel of electron beams, comprises a first, a second and a third electrode for generating a pre-focusing lens field, wherein the first, second and third electrodes are provided with apertures for transmitting the electron beams, and the deflection unit is arranged to deflect the electron beams across the display screen;

wherein the electron gun comprises means for generating an auxiliary lens field between the pre-focusing lens field and the main lens field such that the intensity of the auxiliary lens field causes the electron beams to leave the main lens field substantially parallel to the in-line plane, and such that the diameter of the electron beams past the anode side of the main lens field is smaller than or substantially equal to the diameter of an aperture of the second electrode throughout the deflection of the electron beams across the display screen, wherein the means for generating an auxiliary lens field are adapted to generate an astigmatic lens field in the main lens portion such that the intensity at the astigmatic lens field in the direction perpendicular to the in-line plane is stronger than the intensity of the astigmatic lens field in the in-line plane, and wherein in the direction of travel of the electron beams, the inline electron gun further comprises a fourth electrode, a fifth electrode a sixth electrode, and a seventh electrode, which electrodes have apertures for transmitting electron beams, and in that the display device comprises means for applying a grid voltage to the second and fourth electrode and a focus voltage to the third and fifth electrodes.

2. A display device having a cathode ray tube with an in-line electron gun, wherein the electron gun comprises:

a plurality of cathodes;

a first common electrode having a plurality of first openings adjacent said plurality of cathodes;

a second common electrode having a plurality of second openings adjacent said first common electrode;

a third common electrode having a plurality of substantially circular third openings adjacent said second common electrode;

a fourth common electrode having a plurality of rectangular fourth openings adjacent said third common electrode;

a fifth common electrode having a plurality of rectangular fifth openings adjacent said fourth common electrode;

a sixth common electrode adjacent said fifth common electrode, said sixth common electrode having a first plurality of rectangular sixth openings that are proximate said fifth common electron, and a second plurality of rectangular sixth openings that are disposed away from said fifth common electrode; and a seventh common electrode having a plurality of rectangular seventh openings adjacent said sixth common electrode, wherein grid voltages are applied to said first and second common electrodes, a focus voltage is applied to said fourth and sixth common electrodes, and a variable second focus voltage is applied to said third, fifth, and seventh common electrodes.

3. A display device according to claim 2, wherein a pre-focusing field is formed between said second and third common electrodes.

4. A display device according to claim 3, wherein said pre-focusing field is rotationally symmetrical.

5. A display device according to claim 2, wherein a first quadruple field is formed between said sixth and seventh common electrodes.

6. A display device according to claim 5, wherein a second quadruple field is formed between said fourth and fifth common electrodes.

7. A display device according to claim 2, further including an eighth common electrode that is electrically connected to a grid voltage, wherein a main lens is formed between said seventh common electrode and said eighth common electrode.

8. A display device having a cathode ray tube with an in-line electron gun, wherein the electron gun comprises:

a plurality of cathodes;

a first common electrode having a plurality of first openings adjacent said plurality of cathodes;

a second common electrode having a plurality of rectangular second openings adjacent said first common electrode;

a third common electrode having a plurality of rectangular third openings adjacent said second common electrode;

a fourth common electrode having a plurality of rectangular fourth openings adjacent said third common electrode;

a fifth common electrode having a plurality of rectangular fifth openings adjacent said fourth common electrode; and a sixth common electrode having a plurality of sixth openings adjacent said fifth common electrode; and a grid voltage applied to said second and fourth common electrodes, a focus voltage applied to said third and fifth common electrodes, and a potential applied to said sixth common electrodes, wherein a pre-focusing field is formed between said second and third common electrodes.

9. A display device according to claim 8, wherein said pro-focusing field is an astigmatic lens field.

10. A display device according to claim 8, wherein a first quadruple field is formed between said third and fifth common electrodes.

11. A display device according to claim 8, further including a seventh common electrode that is electrically connected to a grid voltage, wherein a main lens is formed between said seventh common electrode and said sixth common electrode.

* * * * *